US009308427B2

(12) United States Patent
Garner

(10) Patent No.: US 9,308,427 B2
(45) Date of Patent: Apr. 12, 2016

(54) BASKETBALL TRAINING AID

(75) Inventor: Tracy A. Garner, Sewell, NJ (US)

(73) Assignee: Tracy A. Garner, Sewell, NJ (US)

( * ) Notice: Subject to any disclaimer, the term of this patent is extended or adjusted under 35 U.S.C. 154(b) by 0 days.

(21) Appl. No.: 13/063,957

(22) PCT Filed: Sep. 18, 2009

(86) PCT No.: PCT/US2009/057479

§ 371 (c)(1),
(2), (4) Date: Mar. 15, 2011

(87) PCT Pub. No.: WO2010/033803

PCT Pub. Date: Mar. 25, 2010

(65) Prior Publication Data

US 2011/0207101 A1 Aug. 25, 2011

Related U.S. Application Data

(60) Provisional application No. 61/098,332, filed on Sep. 19, 2008.

(51) Int. Cl.

| | |
|---|---|
| ***A63B 69/00*** | (2006.01) |
| ***A63B 43/00*** | (2006.01) |
| *A63B 21/16* | (2006.01) |
| *A63B 41/00* | (2006.01) |

(52) U.S. Cl.

CPC ..... *A63B 69/0071* (2013.01); *A63B 43/00* (2013.01); *A63B 21/1627* (2013.01); *A63B 41/00* (2013.01); *A63B 2225/093* (2013.01)

(58) Field of Classification Search

USPC ..... 434/248; 473/416, 417, 426, 428, 449, 473/614, 615

See application file for complete search history.

(56) References Cited

U.S. PATENT DOCUMENTS

| | | | | | |
|---|---|---|---|---|---|
| 861,506 | A | * | 7/1907 | Doyle | 473/426 |
| 2,697,603 | A | * | 12/1954 | Haines | 473/430 |
| 3,550,937 | A | * | 12/1970 | Patterson et al. | 473/428 |
| 3,558,134 | A | * | 1/1971 | Hoitsma | 473/428 |
| 3,630,521 | A | * | 12/1971 | Lingbeek et al. | 473/426 |
| 4,161,313 | A | * | 7/1979 | Dickey | 473/449 |
| 4,296,925 | A | * | 10/1981 | Alston | 473/430 |
| 4,352,494 | A | * | 10/1982 | Wells | 473/449 |
| 4,383,685 | A | | 5/1983 | Bishop | |
| 4,473,225 | A | * | 9/1984 | Miller | 482/40 |
| 4,565,527 | A | * | 1/1986 | Burchett | 434/248 |
| 4,616,834 | A | * | 10/1986 | Davis | 473/429 |
| 4,717,149 | A | * | 1/1988 | Juhl | 473/429 |
| 4,896,881 | A | * | 1/1990 | Djerdjerian | 482/148 |
| 5,938,547 | A | | 8/1999 | Gilford | |

(Continued)

OTHER PUBLICATIONS

International Search Report and Written Opinion for International Application No. PCT/US2009/057479 filed on Sep. 18, 2009.

(Continued)

*Primary Examiner* — Melba Bumgarner
*Assistant Examiner* — Joseph B Baldori
(74) *Attorney, Agent, or Firm* — Law Offices of Robert F. Zielinski LLC

(57) ABSTRACT

A basketball training aid comprising an axle component and a ball component mounted on the axle component so that the rectilinear axis of the axle component is substantially coincident with a diametric axis of the ball component and so as to be rotatable about the axis of the axle component.

17 Claims, 11 Drawing Sheets

(56) References Cited

U.S. PATENT DOCUMENTS

| | | | | |
|---|---|---|---|---|
| 6,398,673 | B1 * | 6/2002 | Maruca | 473/481 |
| 7,137,909 | B2 * | 11/2006 | Ohle | 473/423 |
| 2003/0069094 | A1 | 4/2003 | Sheppard | |
| 2006/0199685 | A1 * | 9/2006 | Ou | 473/603 |
| 2007/0270247 | A1 | 11/2007 | Wolf | |

OTHER PUBLICATIONS

Chinese Office Action dated Nov. 2, 2012.

* cited by examiner

BASKETBALL TRAINING AID

RELATED APPLICATIONS

This application is a national stage of International Application No. PCT/US2009/057479, filed Sep. 18, 2009, which claims the benefit of U.S. Provisional Application No. 61/098,332, filed Sep. 19, 2008. The entire disclosures of International Application No. PCT/US2009/057479 and U.S. Provisional Application No. 61/098,332 are incorporated herein by reference.

FIELD

The invention relates generally to basketball training aids and, more particularly, to a basketball training aid for improving a basketball player's shooting technique.

BACKGROUND

Shooting a basketball is a skill. Whether or not a player can improve his or her shooting ability is determined to a large extent by whether or not the correct shooting techniques and fundamentals are learned and practiced. Too often, however, younger basketball players who are naturally shorter and weaker than older players develop incorrect shooting habits because they find it easier to reach the basket by using techniques which are fundamentally unsound. For example, it is not unusual for younger players to improperly use their arms and back when shooting a basketball since they find it more natural than using the proper technique with which they are less familiar. However, as a result, many young basketball players develop improper shooting techniques which impede them from improving their shooting ability as they get older.

Various aids have been developed to train basketball players to use proper shooting techniques. For example, U.S. Pat. No. 4,383,685 discloses a basketball training aid which comprises a vest worn by the player with a curved guide bar attached to an elbow sleeve. The player places his or her arm in the sleeve and the curved guide bar simulates the path that a basketball player's arm travels when taking a shot. However, the training aid is bulky and cumbersome to wear. Moreover, the aid is ineffective in teaching the basketball player the correct technique for proper release of a ball at the end of a shot which is an important aspect of shooting technique.

U.S. Pat. No. 5,938,547 discloses a frame with a basketball rotatably attached to the end of the frame. The frame is designed to be attached to the forearm of a basketball player. The basketball player rotates the basketball with the tip of his or her fingers to acclimate himself or herself with the feeling of shooting a basketball. This device, however, must be worn on the player's arm and the weight of the device can affect a player's shot. Iii addition, the device does not allow a player to execute the critical release of the ball as the ball is fixed to the frame.

Accordingly, there is a need for a new and improved basketball training aid for improving a basketball player's shooting technique.

SUMMARY

Disclosed herein is a basketball training aid comprising a ball component and a rectilinear axle component. The ball component is mounted on the axle component so that the rectilinear axis of the axle component is substantially coincident with a diametric axis of the ball component and so as to be rotatable about the axis of the axle component. A pair of coaxial axle portions extend outwardly from diametrically opposed regions of the exterior surface of the basketball component. The axle portions of the axle component have free outer ends that are structured and arranged to be mounted on opposed wall surfaces, such as the opposed vertical jambs of a door frame, so that the axis of the axle component extends substantially horizontally. In one, embodiment the ends of the axle portions are immovably affixable to the opposed wall surfaces. In another embodiment, the free ends of the axle portions are connected to respective slide elements which are guided in respective channels affixed, preferably adjustably, to the opposed wall surfaces. In this embodiment, the ball component is rotatable around the axis of the horizontal axle component and, additionally, the axle component can translate in a substantially vertical direction or at an angle to the vertical.

BRIEF DESCRIPTION OF THE DRAWINGS

A more complete appreciation of the present invention and many of the attendant advantages thereof will be readily understood by reference to the following detailed description when taken in conjunction with the accompanying drawings, in which.

DETAILED DESCRIPTION

Figure 1:
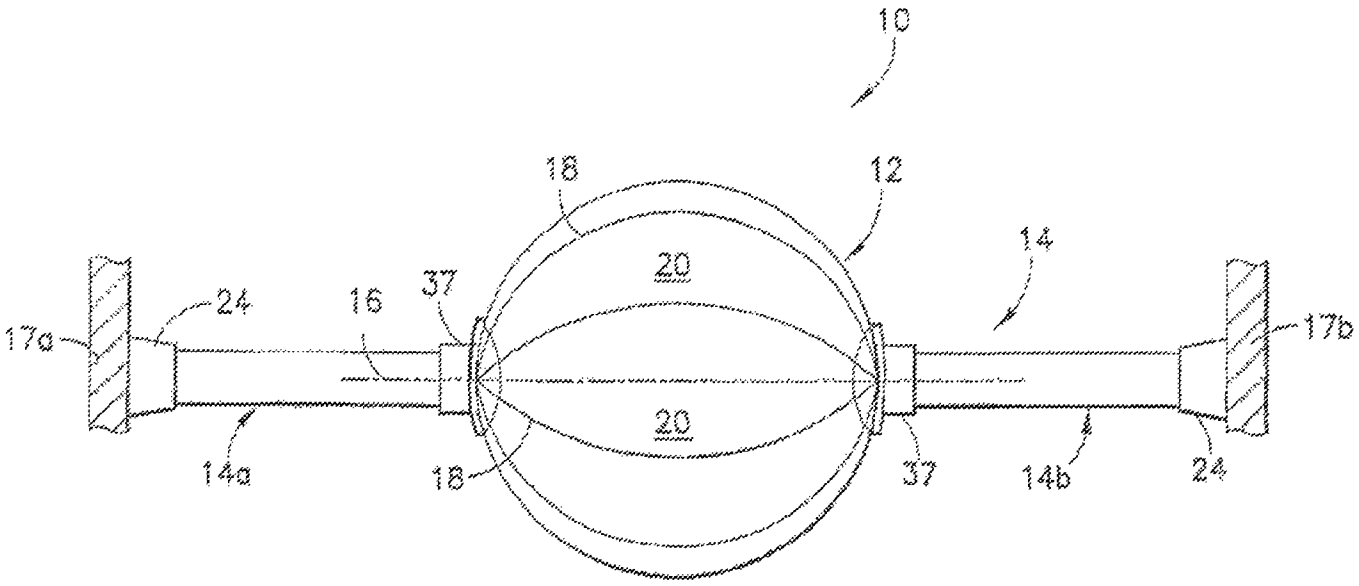
FIG. 1 is a front elevation view of an embodiment of a basketball training aid in accordance with the present invention set up for use.

Referring now the drawings wherein like reference characters designate identical or corresponding parts throughout the several views, and more particularly to FIG. 1, a basketball training aid in accordance with a first embodiment of the invention, generally designated 10, comprises a ball component 12 mounted on a mid-region of a rectilinear axle component 14. The ball component 12 in the illustrated embodiment has the same size and shape as a conventional basketball. In other embodiments, the ball component 12 may be smaller or larger than a conventional basketball. For example, when the aid is intended for training younger children, the ball component 12 may be smaller than a conventional basketball. In still other embodiments, the ball component 12 may have a size and/or shape which is different from a conventional basketball. For example, the ball component 12 may be cylindrical or egg-shaped.

The ball component 12 is mounted on the axle component 14 so that the rectilinear axis 16 of the axle component 14 is coincident with a diametric axis of the ball component 12 so as to rotatable about the axis of the axle component 14.

A pair of coaxial axle portions 14*a* and 14*b* extend outwardly from diametrically opposed regions of the exterior surface of the basketball component 12. The ball component 12 is mounted on the axle component 14 for rotation with respect to the axis of the axle component. In the present embodiment, the basketball component 12 can be freely spun on the axle component 14 while the axle component is fixed. The axle component is structured and arranged to be fixedly mounted between a pair of opposed wall surfaces 17*a*, 17*b*. In the illustrated embodiment, the opposed wall surfaces are of the opposed vertical jambs of a door frame, although it is understood that the training aid can be mounted in a hallway or other suitable location. The training aid is mounted so that the axle component 14 extends horizontally at a height determined by the size of the player using the aid, as discussed below.

Figure 2:
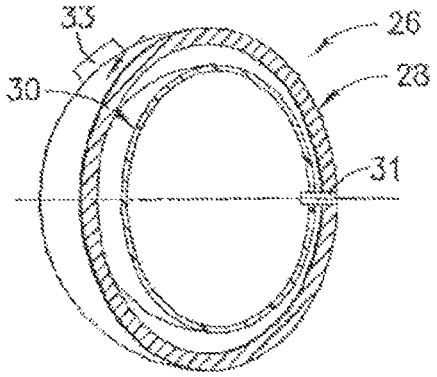
FIG. 2 is a schematic section view of a conventional basketball taken along a plane passing through a diametric axis of the basketball.

Referring to FIG. 2, a conventional basketball 26 comprises a generally spherical interior air bladder 30 which may be wound with monofilament strands. A carcass 28 of uniform thickness defining a substantially spherical outer surface is formed over the winding layer on bladder 30. A plurality of sewn-together leather panels (partially shown in FIG. 2) form a cover 33 for the outer surface of carcass 28. The bladder 30 is inflated through a valve 31 to a pressure at which it bears against the inner surface of carcass 28.

Figure 3:
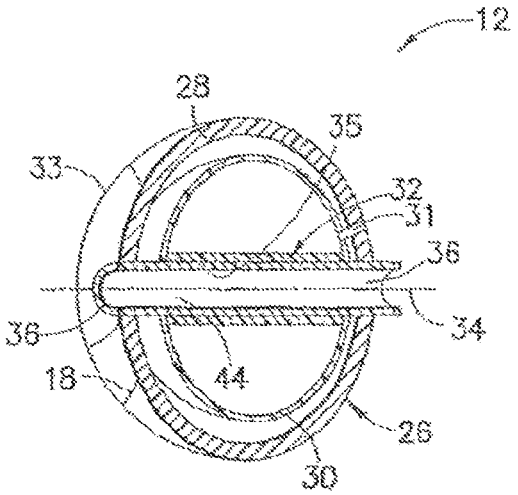
FIG. 3 is a view similar to FIG. 2 showing a basketball component of a training aid in accordance with the present invention.

Referring to FIG. 3, in one manner of constructing a basketball component 12 for a training aid in accordance with the invention, the conventional spherical air bladder is replaced by a toroidal construction, the major portion of whose outer surface has a spherical shape but which defines a diametrically extending tubular opening 35 therethrough. A rectilinear tubular member 32 formed of any suitable plastic or metallic material is situated within and extends through the opening 35 of the bladder 30 and aligned openings in the carcass 28 and cover 33 with its axis coincident with a diametric axis 34 of the basketball 26. End regions 36 of the tubular member 32 preferably project a short distance outwardly of the outer surface of cover 33. The tubular member 32 may be connected to the basketball 26 such as by glue or other adhesive, so that the tubular member 32 is fixedly connected to the basketball 26 to thereby form the ball component 12.

Figure 4:
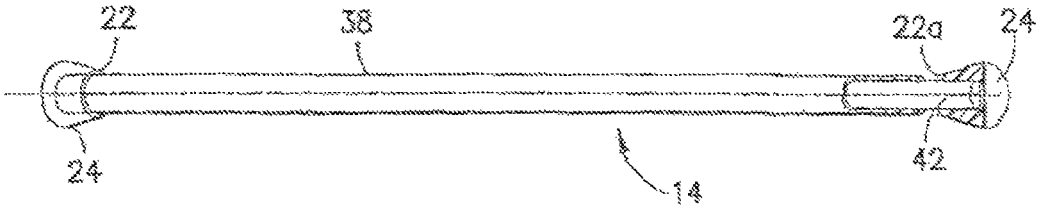
FIG. 4 is a perspective view of an axle component of a training aid in accordance with the present invention.

One manner of construction of axle component 14 is shown in FIG. 4. Axle component 14 comprises an elongated rectilinear tubular member 38 formed of aluminum or other suitably rigid material. One of the ends 22*a* of the tubular member 38 is internally threaded and an externally threaded bushing 42 is threadedly coupled to the internally threaded end 22*a* of tubular member 38 so as to effectively extend the length of the axle component 14. Rubber end caps 24 are placed on the free ends 22 of the axle component, one of the free ends 22 being constituted by the free end of bushing 42. By rotating bushing 42 with respect to the tubular member 38, the bushing may be withdrawn into the end of the tubular member 38 or extend further outwardly from the end of the tubular member 38 thereby effectively shortening or lengthening the axle component.

Figure 5:
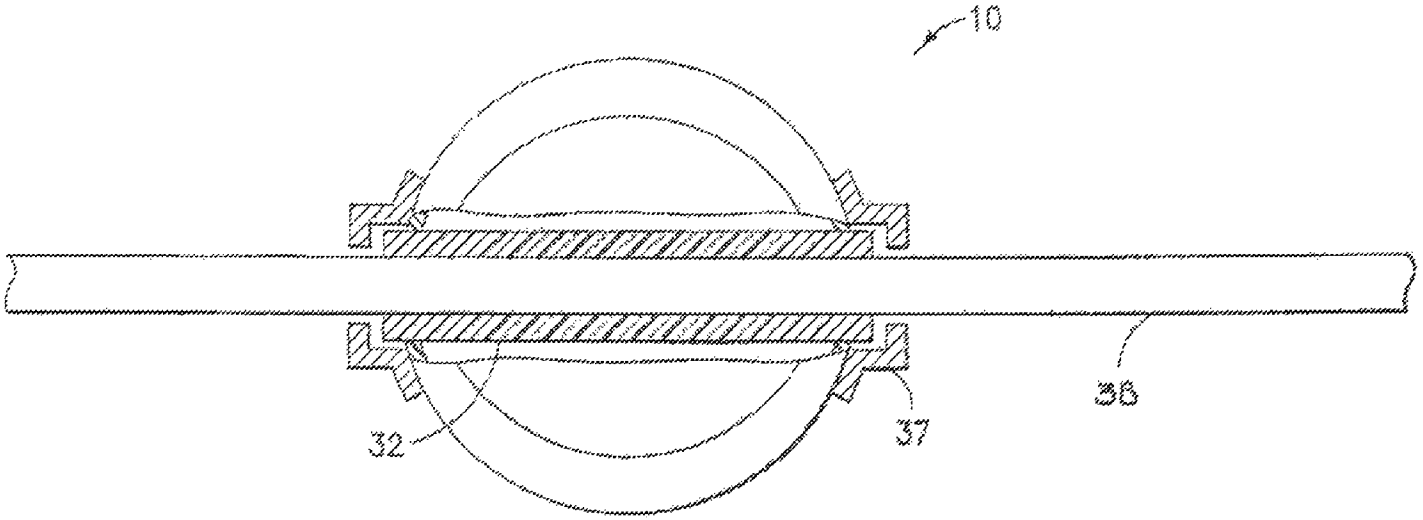
FIG. 5 is a perspective view of an assembly of a ball component and an axle component in accordance with the present invention.

Referring to FIG. 5, the basketball training aid 10 is assembled by inserting the axle component 14 into the tubular member 32 of the ball component 12 until the ball component 12 is situated at a mid-region of the axle component 14. C-clips (not shown) may be provided for engaging corresponding grooves (not shown) formed in the axle component 14 to lock the ball component 12 at the mid-region of the axle component 14. The C-clips may be located in front of each end of the tubular member 32 to act as a stop to retain the ball component 12 at the mid-region of the axle component 14. In other embodiments, the location of the ball component 12 may be permanently situated or adjustably movable to the left or right of the mid-region of the axle component 14 (e.g., by relocating and/or adding additional C-clip axle grooves) no that the player can stand in the center of the doorway while operating the ball component 12 (instead of standing to the left of the ball component 12 (right handed player) or to the right of the ball component 12 (left handed player). In such embodiments, the player would simply remove the C-clips and reposition them in the other grooves to locate the ball component 12 to the left or right of the mid-region of the axle component 14, as desired. It should be understood, that any other suitable locking structure including but not limited to pins, clamps, detents, and the like, may be used for constraining the lateral movement of the ball component 12 relative to the axle component 14. The inner diameter of the tubular member 32 of ball component 12 is slightly greater than the outer diameter of the tubular member 38 of the axle component so that the ball component 12 can spin freely on the axle component 14. The ball component 12 may be fixed against sliding in an axial direction along the axle component 14 by any method including, for example, clips. End caps 37 cover the protruding ends 36 of the tubular member 32.

Prior to describing the use of this embodiment of the teaching aid, certain elements of a generally accepted technique for jump shooting be described. At the beginning of a shot, the upper arm is generally parallel to or forms an acute angle with the floor while the forearm extends in a generally vertical direction. Using the shoulder as a hinge the angle between the upper arm and forearm increases. Importantly, the forearm moves in a generally vertical direction rather than towards the basket. Just prior to reaching the apex of the shot, the elbow is straightened and the shooter flexes his or her wrist so that the palm faces upward and forward. The shooter then releases the ball by rotating his or her wrist and hand forwardly so that the ball rolls off the fingertips of the shooter's hand. This rolling of the ball off the fingertips imparts a backspin rotation to the ball which causes the ball to land softly on the rim. The ball should not be pushed with the heel of the palm but rather should roll off the fingertips. The shooter's wrist should flex downwardly so that the palm faces the floor upon completing the release.

The above-described embodiment of the present invention is designed to train a player to release the basketball with his or her arm extending at the proper angle from vertical with the elbow straightened and so that the ball rolls off the tips of the fingers as the wrist flexes down.

Figure 6:
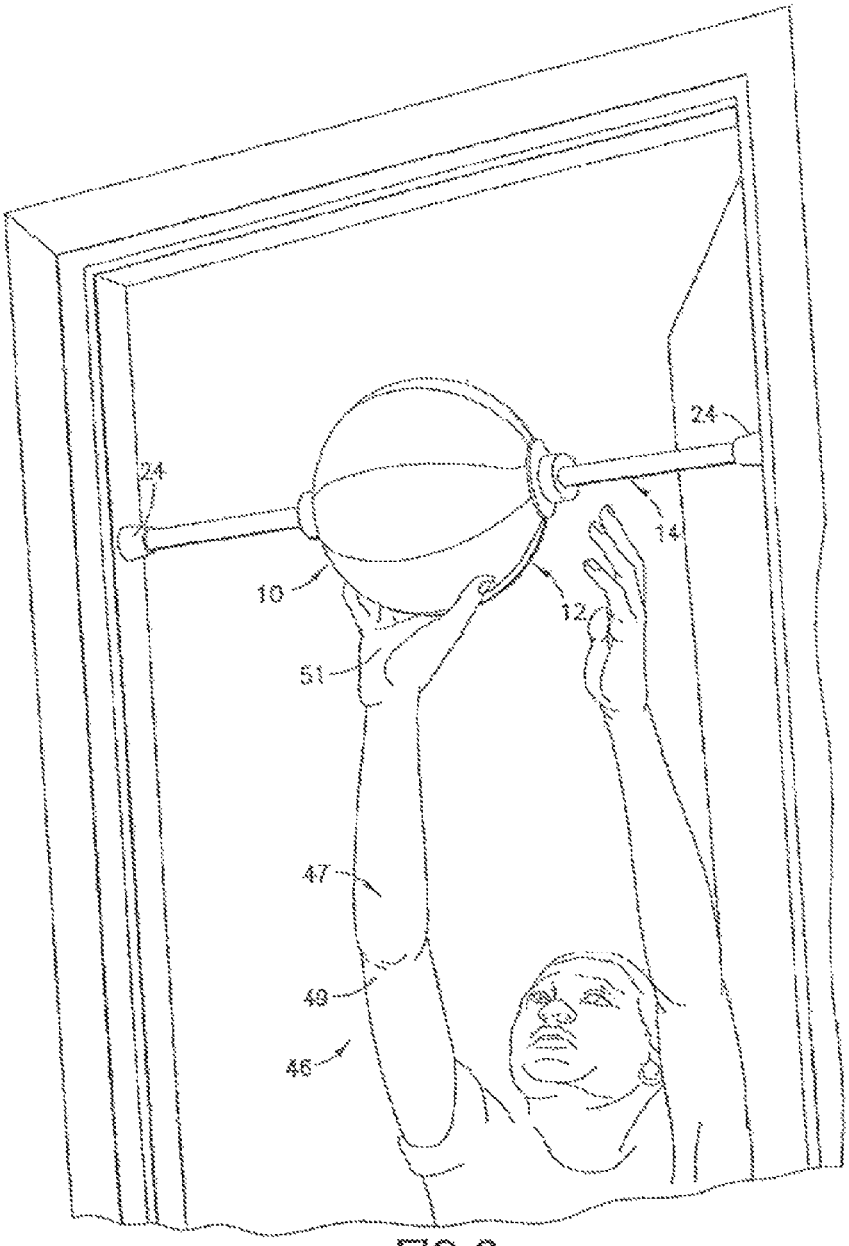
FIG. 6 is a perspective view of a first embodiment of basketball training aid in accordance with the present invention fixed in a door frame and in use.

Referring to FIG. 6, the training aid 10 is positioned in a doorway at a height at which the ball is released during a shot as determined by the height of the player 46 as follows. The player 46 extends her shooting arm 47 at the proper angle from vertical (i.e., slightly towards the "basket") with the elbow 49 slightly bent and with her palm 51 facing upwardly and forwardly. The training aid 10 is positioned so that the players fingers grip the ball component 12. With the ball component held at that height, the length of the axle component 14 is increased by rotating bushing 42 so that the ends of the axle component bear forcefully against the side jambs of the doorway. The rubber end caps 24 serve to facilitate a secure affixation of the training aid 10 in position. Once the training aid is positioned, the player positions herself so that her arm 47 is in the correct position at the proper angle from vertical (i.e., slightly towards the "basket"). The player grips the ball component whereupon the wrist and hand are flexed forwardly while pushing up towards the basket and a spin is imparted to the ball component. The player's wrist continues to flex until the palm faces downwardly. Thereafter, the player can repeat the release movement by flexing the wrist forwardly to spin the ball. By repeating this action, the player learns the correct position of his or her forearm and upper arm at the point of the release of the basketball and additionally reinforces the wrist action that characterizes the correct release of the basketball.

Figure 7:
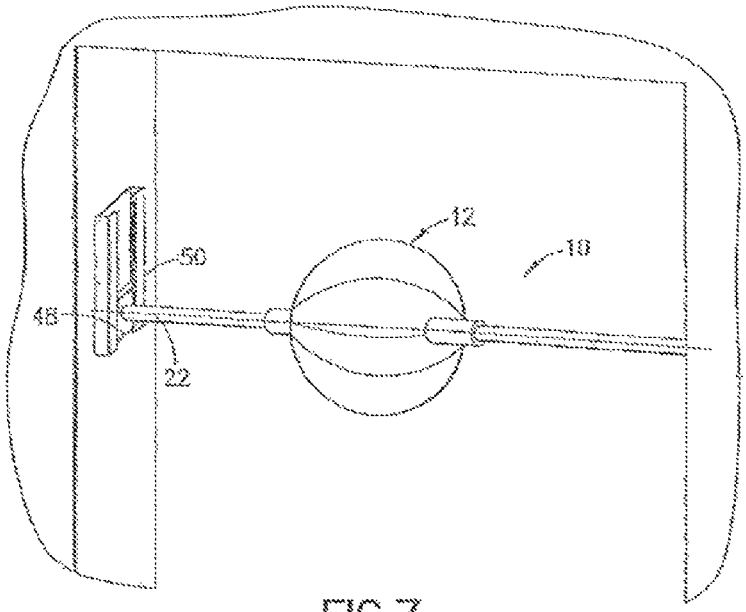
FIG. 7 is a perspective view of a second embodiment of a basketball training aid in accordance with the present invention mounted in a door frame.
Figure 8:
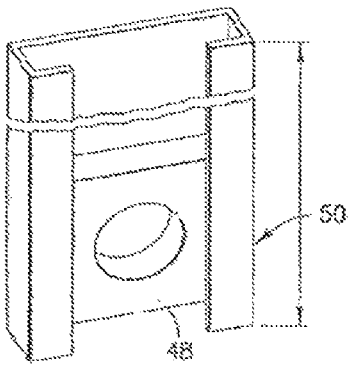
FIG. 8 is a perspective view of a slide arrangement including a slide member situated in a channel for use in the second embodiment of the present invention.

Referring to FIGS. 7 and 8, a second embodiment of a training aid 10 in accordance with the invention is illustrated. The embodiment is substantially the same as the first embodiment except that it includes a track arrangement that allows the ball component 12 to be raised from a resting position. The track arrangement includes slide members 48 (only one shown) are connected to the free ends 22 of the axle component 14. A pair of rectilinear channels 50 (only one shown), each of which is closed at its lower end, are fastened to the opposed vertical door jambs at an appropriate height and extend substantially vertically. In this manner, when the ball component 12 is raised, the slide members elevate in their respective channels. The channels 50 may be angled slightly forwardly to approximate the trajectory of the ball at the top of the shot.

Figure 9:
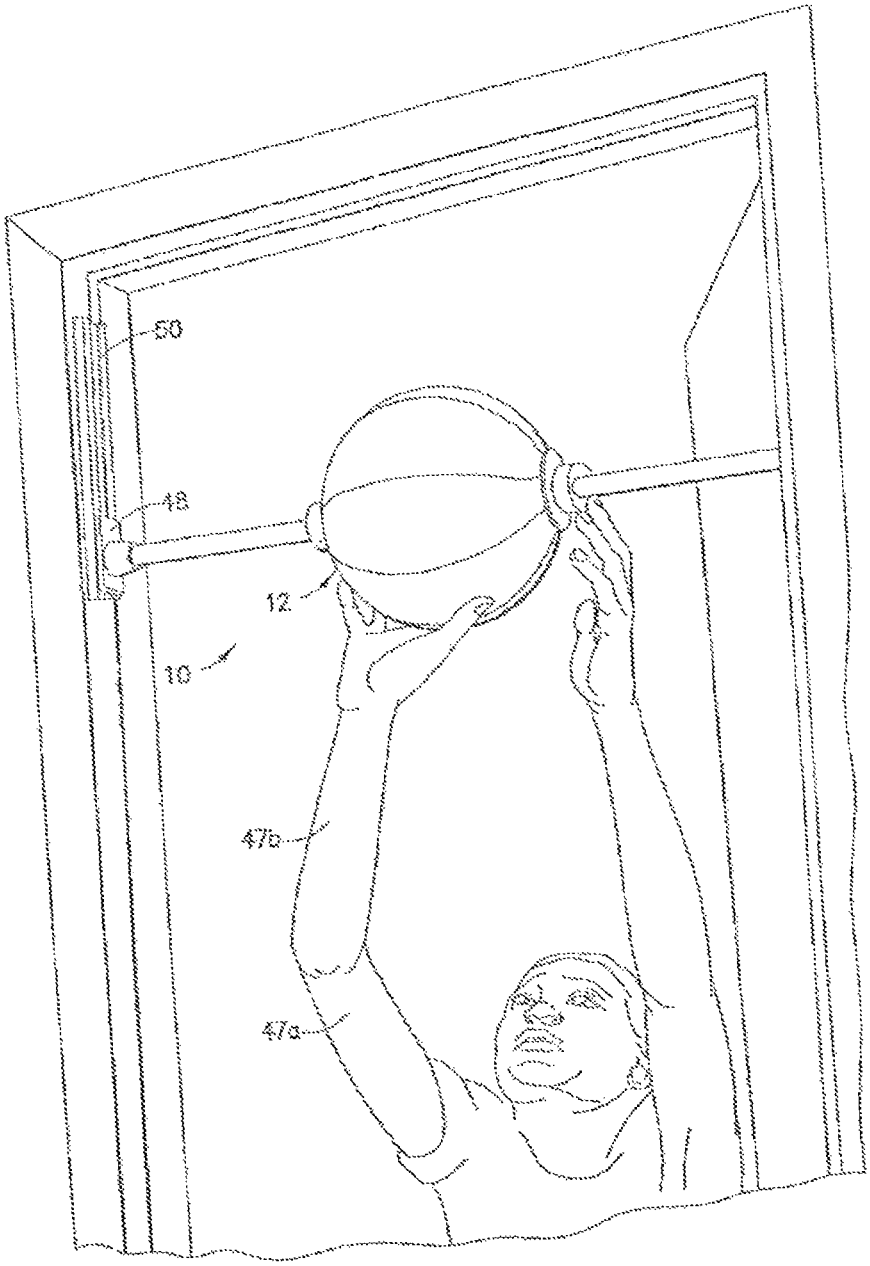
FIG. 9 is a perspective view of the second embodiment of a basketball training aid in accordance with the present invention mounted in a door frame and in use at the base point of a shot.
Figure 10:
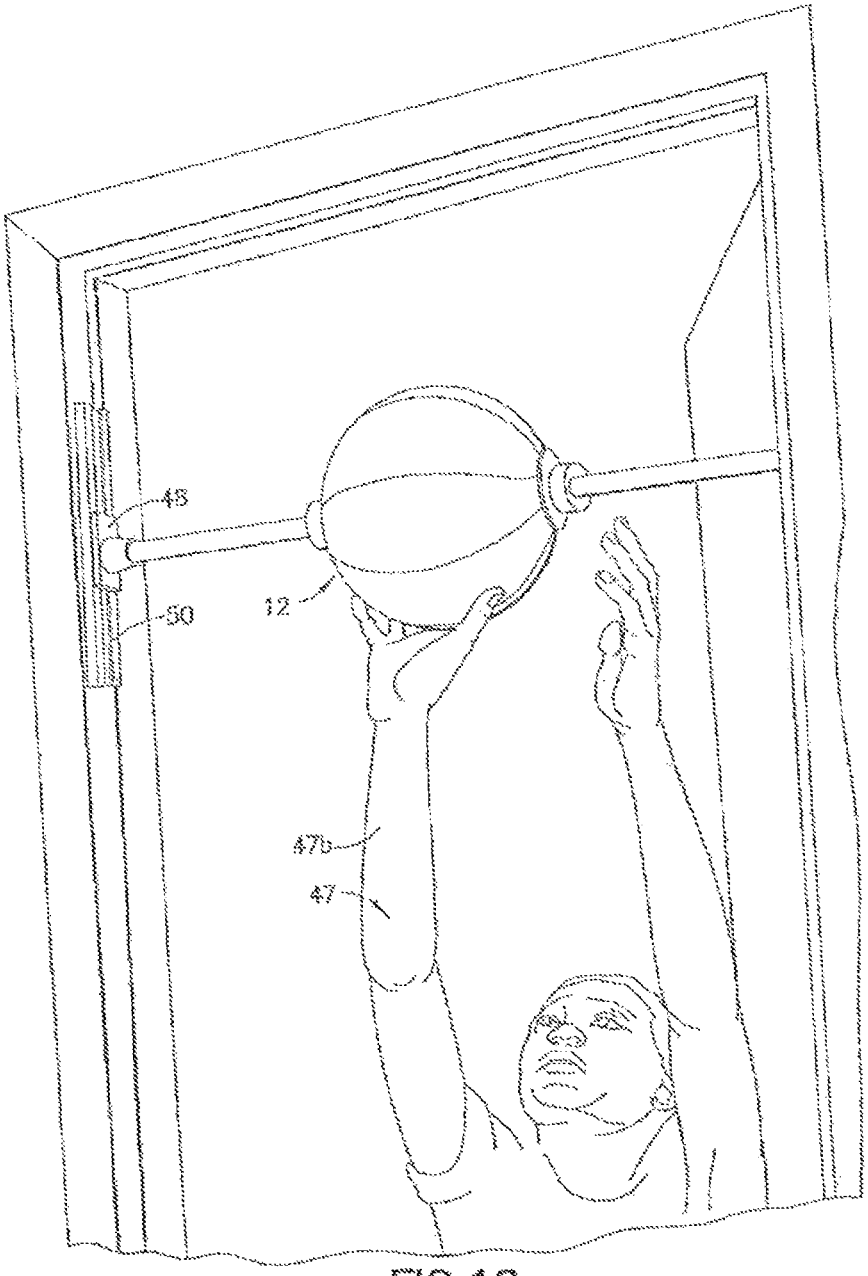
FIG. 10 is a view similar to FIG. 9 of the second embodiment of a basketball training aid in accordance with the present invention and in use at the mid-point of a shot.

Referring to FIG. 9, the training aid 10 is positioned so that the basketball component 12 is positioned where the particular shooter would be holding the ball at the base of the apex point of a jump shot. Note that the upper arm 47*a* of the shooter's shooting arm forms an angle with the floor while the forearm 47*b* is substantially vertical. The channels 50 are affixed to the door jamb so that with the training aid 10 at this height the slide members 48 are situated at the bottom regions of the respective slides 50. As seen in FIG. 10, as the shooter straightens her arm 47 and reaches a mid-point of the shot, the basketball component 12 is constrained by the channels 50 to move in a substantially vertical direction so that the shoot's forearm 47*b* is likewise constrained to move vertically upwardly in a proper fashion rather than forwardly. The slide members 48 have at this point moved to approximately the mid-height regions of the channels 50.

Figure 11:
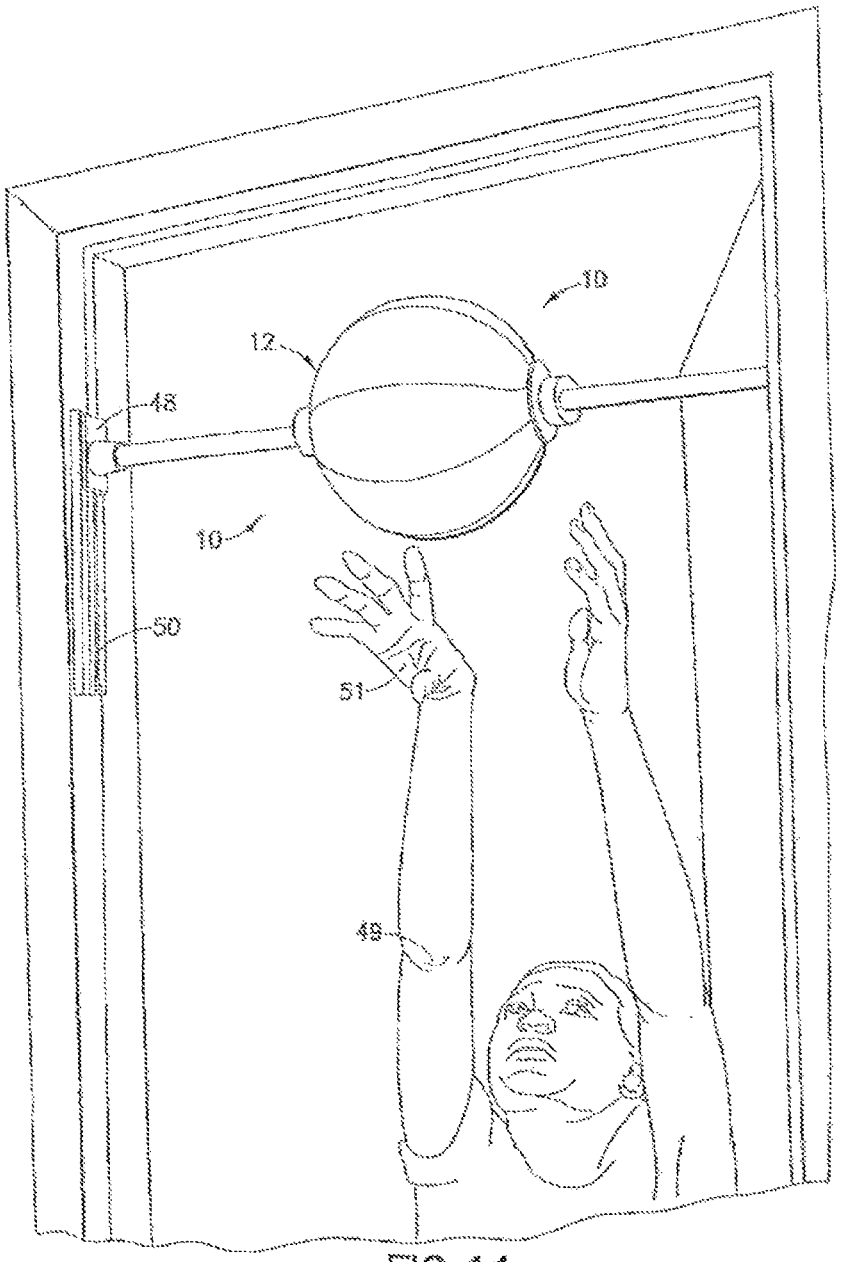
FIG. 11 is a view similar to FIGS. 9 and 10 of the second embodiment of a basketball training aid in accordance with the present invention and in use at the release point of a shot.

Referring to FIG. 11 which shows the training aid 10 at the release point of the shot, the shooter's elbow 49 has straightened and her arm is at some angle from vertical facing slightly forward. The shooter's wrist and hand have flexed forwardly so that the ball has rolled off her fingers imparting a backspin. The shooter's palm 51 finishes facing downwardly. The ball component 12 has reached a height at which the slide members 48 are situated at the top regions of the respective channels 50.

Thus, the second embodiment enables a shooter to repetitively practice the fundamental technique of shooting a basketball, not only at the release point of the shot, but from the base point through the release.

Figure 12:
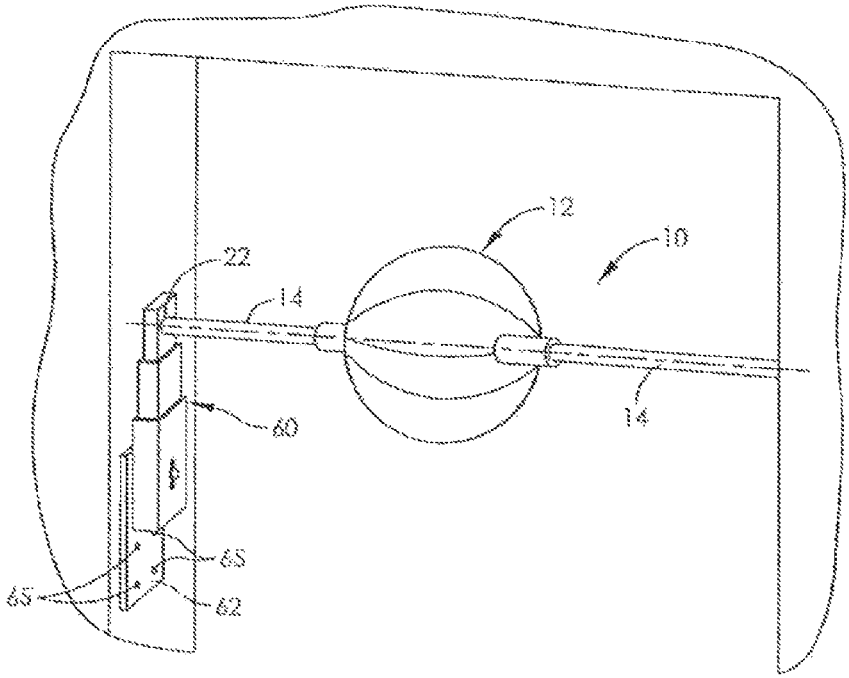
FIG. 12 is a perspective view of a basketball training aid having another embodiment of the slide arrangement, mounted in a door frame.

FIG. 12 illustrates another embodiment of the track arrangement. The track arrangement includes a pair of extendable track assemblies 60 (only one shown), each of which is fixedly or removably connected to one of the free ends 22 of the axle component 14. The extendable track assemblies 60 are capable of being extended and collapsed to allow the ball component 12 to be raised (for example, but not limitation, 24-26 inches) and then fall back to a resting position. The track arrangement further includes a pair of attachment members 62 (only one shown) with two or more apertures 64 (FIG. 13A) for fastening the extendable track assemblies 60 to the two opposed vertical wall surfaces (e.g., door jambs) at an appropriate height using, for example but not limitation, screw fasteners 65.

Figure 13A:
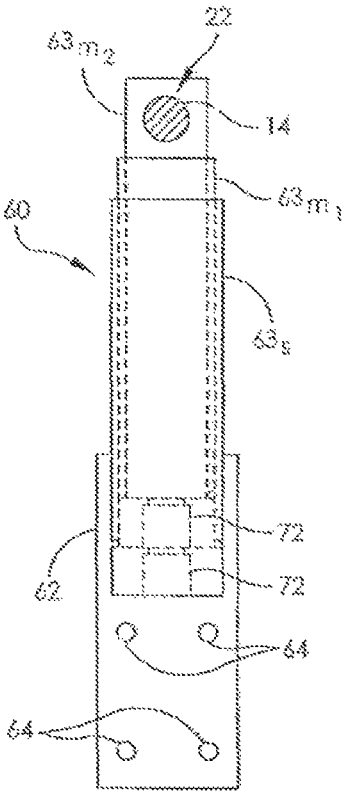
FIG. 13A is an elevational view of an extendable track assembly and attachment member of the slide arrangement of FIG. 12, illustrating the extendable track assembly in a collapse position.
Figure 13B:
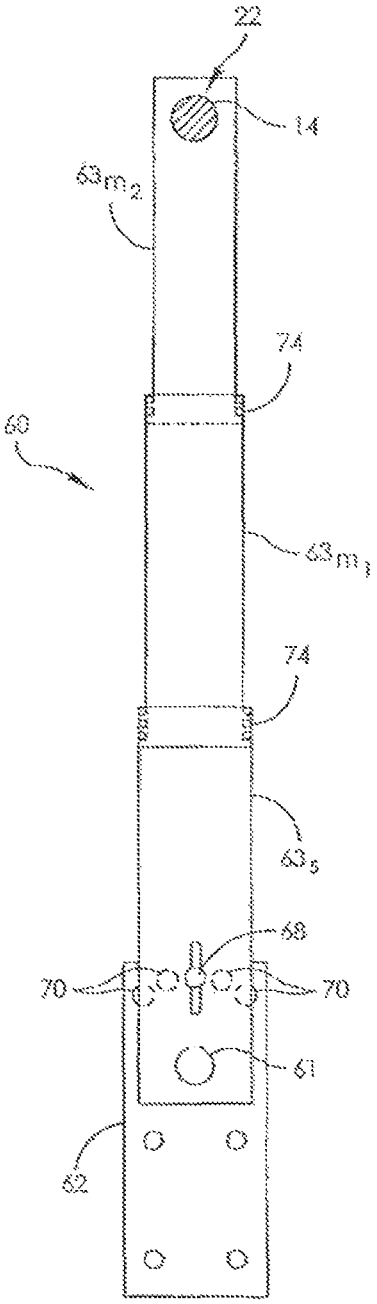
FIG. 13B is an elevational view of the extendable track assembly and attachment member of FIG. 13A, illustrating the extendable track assembly in an extended position.
Figure 13C:
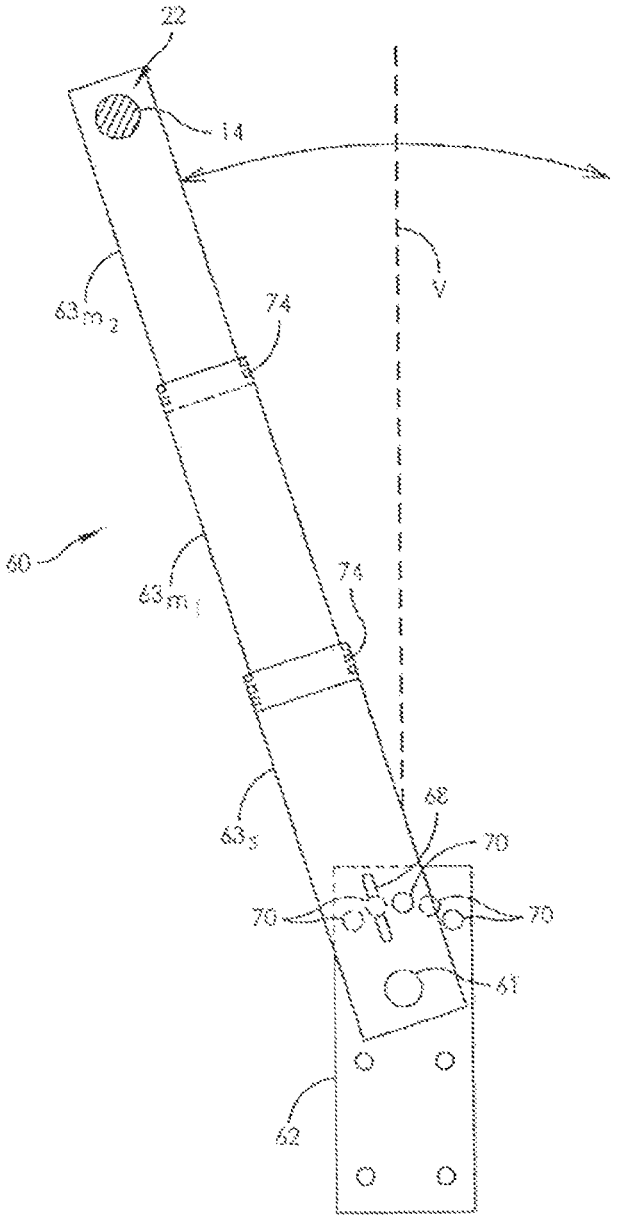
FIG. 13C is an elevational view of the extendable track assembly and attachment member of FIGS. 13A and 13B, illustrating the extendable track assembly in an extended position and angled relative to the attachment member.

Referring collectively to FIGS. 13A-13C, each extendable track assembly 60 includes a vertically stationary track section 63*s* and one or more movable track sections $\mathbf{63}m_1$ and $\mathbf{63}m_2$. The vertically stationary track section 63*s* is fixedly or pivotally connected to its associated attachment member 62 by a pivot pin 61 (FIGS. 13B and 13C). In embodiments where the vertically stationary track section 63*s* is pivotally connected to the attachment member 62, a thumb screw wing bolt 68 passing through an opening (not visible) in the stationary track section 63*s* and engaging one of two or more an angle adjustment recesses or apertures 70 (shown with broken lines) in the attachment member 62, may be used to adjust the angle of the extendable track assembly 60 relative to its associated attachment member 62 (or the angle measured from vertical line V), as shown in FIG. 13C. In other embodiments, the thumb screw wing bolt 68 may be replaced by a spring biased detent (not shown).

Referring still to FIGS. 13A-13C, the first movable track section $\mathbf{63}m_1$ is slidably disposed with respect to the vertically stationary track section 63*s* and the second movable track section $\mathbf{63}m_2$ is slidably disposed with respect to the first movable track section $\mathbf{63}m_1$. The free end 22 of the axle component 14 fixedly or removably attaches to the outer end of the second movable track member $\mathbf{63}m_2$. The extendable track assembly 60 may be provided with spring or fluid-based (air, water, oil, etc.) external or internal dampers (internal dampers 72 shown with broken lines) to dampen the movement of the movable track sections $\mathbf{63}m_1$ and $\mathbf{63}m_2$ at their collapsed limits of travel to eliminate crashing of the movable track sections $\mathbf{63}m_1$ and $\mathbf{63}m_2$ as the ball component 12 returns to the resting position via gravity. The extendable track assembly 60 may also be provided with spring or fluid-based air, water, oil, etc.) external or internal dampers (internal dampers 74 shown with broken lines) to dampen the movement of the movable track sections $\mathbf{63}m_1$ and $\mathbf{63}m_2$ at their extended limits of travel to eliminate crashing of the movable track sections $\mathbf{63}m_1$ and $\mathbf{63}m_2$ as the ball component 12 is raised by the shooter.

As one of ordinary skill in the art will appreciate, numerous variations and modifications of the basketball training aid are possible in the light of the above teachings. For example the ball and axle components may have other configurations including without limitation, a configuration that allows a conventional basketball to be utilized in place of the ball component and which is removable from the axle component. The axle component may be formed of one or more sections which may or may not be in telescoping relationship with each other. The dimensions and shape of the components of the track arrangement may be different from that shown and other track arrangements using rollers, bearings, slides, belts, and the like, may be used for allowing the ball component to be raised and lowered to the resting position. Thus, the disclosed embodiments shall be regarded as illustrative rather than restrictive, and it should be understood that variations may be made in those embodiments by workers skilled in the arts without departing from the scope of the present invention as set forth in the claims that follow and their structural and functional equivalents.

What is claimed is:

1. A basketball training aid comprising:

a ball component having a diametric axis and a tubular component which passes through two diametrically opposing sides of the ball component and extends outwardly beyond an exterior surface of the ball component, the tubular component having an inner diameter and a rectilinear axis that is coincident with the diametric axis of the ball component; and a rigid axle component having a tubular shape with an outer diameter and a rectilinear axis, the rectilinear axis of the axle component being substantially coincident with the diametric axis of the ball component and the axis of the tubular component along an entire length of the axle component during normal operating use such that the axle component passes through the tubular component, permitting the ball component to rotate about the axle component, the outer diameter of the axle component being slightly smaller than the inner diameter of the tubular component so that the ball component is configured to rotate about the axle component such that the axes of the tubular component, the diametric axle of the ball component and the rectilinear axis of the axle component remain coincident during rotation and during normal operating use, wherein the axle component has free ends, wherein the free ends of the axle component project from the ball component and are coupled to members adapted to be movable in a track arrangement mounted on opposed surfaces that allows the ball component to be raised and then fall back to a resting position, and wherein the ball component is configured to rotate about the axle component when a force is applied to the ball component during normal operating use without causing deformation of the axle component.

2. A basketball training aid according to claim 1 wherein the axle component has a variable length.

3. A basketball training aid according to claim 2 wherein said axle component is formed of telescoping members.

4. A basketball training aid according to claim 1 wherein end caps are affixed to said free ends of said axle component.

5. A basketball training aid according to claim 1 wherein the ball component is formed with an air bladder defining an opening therethrough.

6. A basketball training aid according to claim 5 wherein said ball component includes a tubular member situated on a diametric axis of said ball component and passing through said opening of said bladder.

7. A basketball shooting aid according to claim 1 wherein the track arrangement cooperates with the axle component that constrains translational movement to one axis that is perpendicular to the axis of the tubular component.

8. A basketball training aid according to claim 1 wherein the ball component has an air inflated interior bladder, the bladder is fixedly mounted on the tubular component which extends outwardly beyond an innermost interior surface and an outermost exterior surface of the ball component such that the bladder remains in an inflated condition and further comprising end caps that secure both ends of the ball component to respective extending ends of the tubular component, covering protruding portions of the tubular component, the end caps permitting the axle component to pass through the caps.

9. A basketball shooting aid according to claim 1 wherein the rigid axle component is inelastic and is configured not to deform or to bend when a force is applied to the ball component during normal operating use.

10. A basketball training aid comprising:

a ball component having a diametric axis and a tubular component which passes through two diametrically opposing sides of the ball component and extends outwardly beyond an exterior surface of the ball component, the tubular component having an inner diameter and a rectilinear axis that is coincident with the diametric axis of the ball component; and a rigid axle component having a tubular shape with an outer diameter and a rectilinear axis, the rectilinear axis of the axle component being substantially coincident with the diametric axis of the ball component and the axis of the tubular component along an entire length of the axle component during normal operating use such that the axle component passes through the tubular component, permitting the ball component to rotate about the axle component, the outer diameter of the axle component being slightly smaller than the inner diameter of the tubular component so that the ball component is rotatable about the axis of the axle component such that the axes of the tubular component, the ball component, and the axle component remain coincident during rotation and during normal operating use, wherein the axle component has free ends, wherein the free ends of the axle component are coupled to members adapted to be movable in a track arrangement mounted on opposed surfaces that allows the ball component to be raised and then fall back to a resting position, and wherein the ball component is configured to rotate about the axle component when a force is applied to the ball component during normal operating use without causing deformation of the axle component.

11. A basketball training aid according to claim 10 wherein said track arrangement includes a pair of extendable track assemblies, each of which is fixedly or removably connected to one of said free ends of said axle component.

12. A basketball training aid according to claim 11 wherein said track arrangement further includes a pair of attachment members for fastening the extendable track assemblies to opposed surfaces.

13. A basketball training aid according to claim 12 wherein said track arrangement is capable of being angled relative to said attachment members.

14. A basketball training aid according to claim 10 wherein the ball component has an air inflated interior bladder, the bladder is fixedly mounted on the tubular component which extends outwardly beyond an innermost interior surface and an outermost exterior surface of the ball component such that the bladder remains in an inflated condition and further comprising end caps that secure both ends of the ball component to respective extending ends of the tubular component, covering protruding portions of the tubular component, the end caps permitting the axle component to pass through the caps.

15. A basketball shooting aid adapted to train basketball players the proper wrist flex action at the release point of a basketball shot, comprising:

a ball component, the ball component having an air inflated interior bladder, the bladder is fixedly mounted on a tubular component which passes through two sides of the ball component and extend outwardly beyond an innermost interior surface and an outermost exterior surface of the ball component such that the bladder remains in an inflated condition; and a rigid tubular axle component, the axle component passes through the tubular component and is coaxial along an entire length of the axle component with the ball component during normal operating use and permitting the ball component to rotate about the axle component, the tubular axle component having an outer diameter that is slightly smaller than an inner diameter of the tubular member so that the ball component is rotatable about the axle component such that axes of the tubular component, the ball component, and the axle component remain coincident during rotation and during normal operating use, wherein the ball component is configured to rotate about the axle component when a force is applied to the ball component during normal operating use without causing deformation of the axle component wherein free ends of the axle component are coupled to members adapted to be movable in a track arrangement mounted on opposed surfaces that allows the ball component to be raised and then fall back to a resting position.

16. A basketball shooting aid according to claim 15 wherein the ball component comprises an outermost skin layer, an intermediate carcass, an innermost air bladder, and an air valve for inflation.

17. A basketball shooting aid according to claim 15 further comprising end caps that secure both ends of the ball component to respective extending ends of the tubular component, covering protruding portions of the tubular component, the end caps permitting the axle component to pass through the caps.

* * * * *